United States Patent [19]

Held

[11] Patent Number: 4,640,758

[45] Date of Patent: Feb. 3, 1987

[54] APPARATUS FOR THE ELECTRODEPOSITION OF A COATING ON AN ENDLESS BELT

[76] Inventor: Kurt Held, Alte Strasse 1, D-7218 Trossingen 2, Fed. Rep. of Germany

[21] Appl. No.: 837,017

[22] Filed: Mar. 6, 1986

[30] Foreign Application Priority Data

Mar. 15, 1985 [DE] Fed. Rep. of Germany ..... 3509388

[51] Int. Cl.[4] ..... C25D 17/00

[52] U.S. Cl. ..... 204/272

[58] Field of Search ..... 204/272, 212

[56] References Cited

U.S. PATENT DOCUMENTS 3,507,770 4/1970 Fleming ..... 204/272

*Primary Examiner*—T. M. Tufariello

*Attorney, Agent, or Firm*—Toren, McGeady and Goldberg

[57] ABSTRACT

For the electrodeposition of a metal coating onto a surface of an endless belt, such as a press belt for use in a double band press, an annular bath is formed by a pair of endless belts. The belts have different diameters and are arranged concentrically about a center point on a horizontal base plate. The belts extend vertically upwardly from the base plate so that one belt forms the radially inner surface of the bath and the other forms the radially outer surface, an aqueous electrolytic solution is filled into the annular bath. An anode is supported in the bath and one of the endless belts forms a cathode. The anode and cathode are connected to a constant voltage source and a metal coating can be deposited on the belt acting as the cathode. A mast extends vertically upwardly from the center point and is supported on the base plate. Horizontal arms extend outwardly in opposite directions from the mast and support the anode. The mast rotates about its vertical axis with the anode moving through the annular bath.

27 Claims, 6 Drawing Figures

APPARATUS FOR THE ELECTRODEPOSITION OF A COATING ON AN ENDLESS BELT

BACKGROUND OF THE INVENTION

The present invention is directed to a method of and an apparatus for the electrodeposition of a metal coating on a metallic endless belt, such as a press belt for use in a double band press. The belt to be coated is wired as an cathode and is located in an electrolytic bath with an anode so that the electrolyte dissociates into ions with the ions containing the metal atoms forming the coating. The cathode and the anode are connected to the corresponding poles of a constant voltage sourse.

Such belts, used chiefly as press belts in double band presses, are utilized for applying surface pressure on sheetlike workpieces, such as decorative laminated materials, chip boards, fiber plates, electro-laminates and the like. The material being pressed is directed between two continuously circulating endless press belts and pressure is directed against the belts and, if necessary, heat is applied so that the material being pressed is hardened, note German Offenlegungsshrift No. 24 21 296. Normally, such press belts are produced from high-tensile steel.

To prevent the press belts from wearing out too quickly due to the pressure applied during pressing, a hard metallic and wear-resistant layer is electrodeposited onto the surfaces of the press band. If the surface of the material to be pressed is to be provided with a texture, embossing bands are used, similar to the press belts, which consist of a steel band and a soft metallic layer is deposited on the surface of the belt and the layer is provided with the desired texture. A hard layer is then deposited on the soft layer for its protection, note German Patentschrift No. 29 50 795.

To electrodeposit a metal coating on a metallic object, tub-shaped baths are utilized filled with liquid electrolyte which dissociates into ions containing the desired metal atoms to be deposited. An anode, formed of a material with good conductivity, is immersed or dipped into the electrolyte. The item to be coated is completely submerged in the bath and is connected as a cathode. If a constant voltage source is provided outside the bath and is connected to the cathode and the anode, current consisting of the electrolyte ions flows in the bath between the cathode and the anode and the metal ions are transformed at the cathode by the reception of electrons into metal atoms which deposit out on the cathode as a metallic coating.

The baths used in electroplating shops have certain maximum lengths and depths. For entirely accommodating an endless belt in such a bath or tank it has been known to fold the belts and then introduce them into the bath. With this method, however, only belts up to approximately 6 m in length, corresponding to an annular diameter of approximately 2 m, can be coated in the largest available baths. For various applications in double band presses, such as for continuous chip board production, it is necessary to construct long presses having a length of approximately 12 m or more so that the press band has a circumferential length of at least 26 m. Such elongated press belts, however, can no longer be coated conventionally by electrodeposition means.

Another disadvantage of electrodeposition in a conventional bath results from the folding of the press belts. Due to the folding of the belt the surface is located at various distances from the anode and the current density between the anode and the cathode in the bath varies considerably whereby a different thickness of the deposited metal layer on the belt surface results. The different thicknesses of the coating can lead to variations in thickness of the material being pressed and can require a costly secondary operation on the pressed material, such as grinding. Moreover, it has been noted that an increased hydrogen embrittlement takes place in press belts which are coated in conventional baths. Such hydrogen embrittlement leads to cracks and fractures in the deposited metallic coating and can result in the entire press belt being unusable.

SUMMARY OF THE INVENTION

The primary object of the present invention is to provide a method of and apparatus for the electrodeposition of metallic layers or coatings on endless belts of selected circumferential dimensions, whereby the quality of the deposited metallic coating is improved. In accordance with the present invention, a bath of an aqueous electrolytic solution is formed by a base plate and a pair of endless belts secured to and extending upwardly from the base plate with the belts each having a different diameter so that they form an annular bath. An anode is supported in the bath in spaced relation to the endless belts. One of the belts is connected as a cathode to a constant voltage source and the anode is connected to the same source. Accordingly, a metallic coating from the electrolytic solution is deposited out on the surface of the belt forming the cathode.

Among the advantages achieved with the present invention are that the coating of endless bands of a desired circumferential length is possible and the restriction to the maximum dimension of a bath are avoided. Further, the quantity of the electrolytic solution is considerably reduced and the required current intensity can be reduced at the expense of the time required for the deposition or plating. If only one surface of an endless belt is to be coated, it is unnecessary to cover the other surface of the belt, as has been necessary in the conventional method. Moreover, it has been found that a uniform, thick layer is deposited, and the danger of hydrogen embrittlement is also greatly reduced in comparision with conventional methods.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
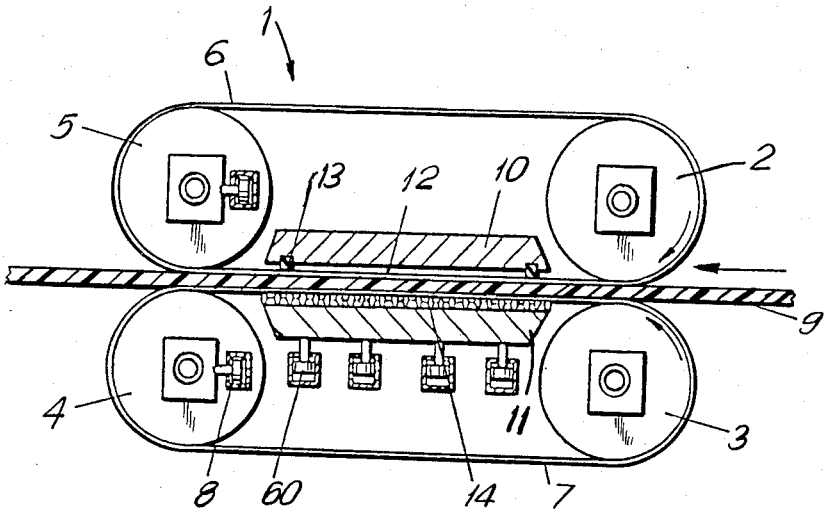
FIG. 1 is a schematic side view of a double band press.

In FIG. 1 a double band press 1 is illustrated including four deflection drums or cylinders 2, 3, 4, 5 supported in a press frame. The press frame is not shown for sake of clarity. An upper press belt 6 is trained around the drums 2 and 5 and a lower press belt 7 is trained around the drums 3 and 4. The direction of rotation of the belts 6 and 7 is indicted by the arrows located on the drums. The press belts 6, 7 are tensioned by the hydraulic cylinders 8 associated with the drums 4, 5. A sheetlike work material 9 moves from the right to the left in FIG. 1 passing between the two endless press belts 6, 7. The work material can be formed of a synthetic resin-impregnated laminated material, fiber-binding agent mixtures or the like and is compressed between the press belts with the simultaneous application of heat and pressure.

Pressure is applied to the sheetlike work material 9 hydraulically or mechanically from the insides of the press belts 6, 7 via upper pressure plate 10 and lower pressure plate 11, in other words, pressure is transmitted from the pressure plates through the press belts to the work material. During hydraulic pressure transmission, a fluid medium under pressure, for example, oil or air, is introduced into the space 12 located between the pressure plate 11 and the upper surface of the lower run of the press belt 6 and the space is limited laterally by a seal 13. Stationary rollers 14 are positioned between the upper surface of the pressure plate 11 and the lower surface of the upper run of the press belt 7 for effecting mechanical pressure transmission. The pressure plate and, accordingly, the rollers 14, are adjusted against the inside of the press belt 7 by means of hydraulic cylinders 60.

Each press belt 6, 7 is an endless belt formed of a high-tensile steel and has an annular shape in the untensioned condition. To prevent the destruction of the belt within a short time by the pressure exerted on the sheetlike work material 9, it is necessary that the surface of the press belt has a considerable hardness. Normally, the required hardness is achieved by an electrodeposited hard chrome coating on the surface with the coating having a thickness of 30 to 100 micrometers.

Figure 2:
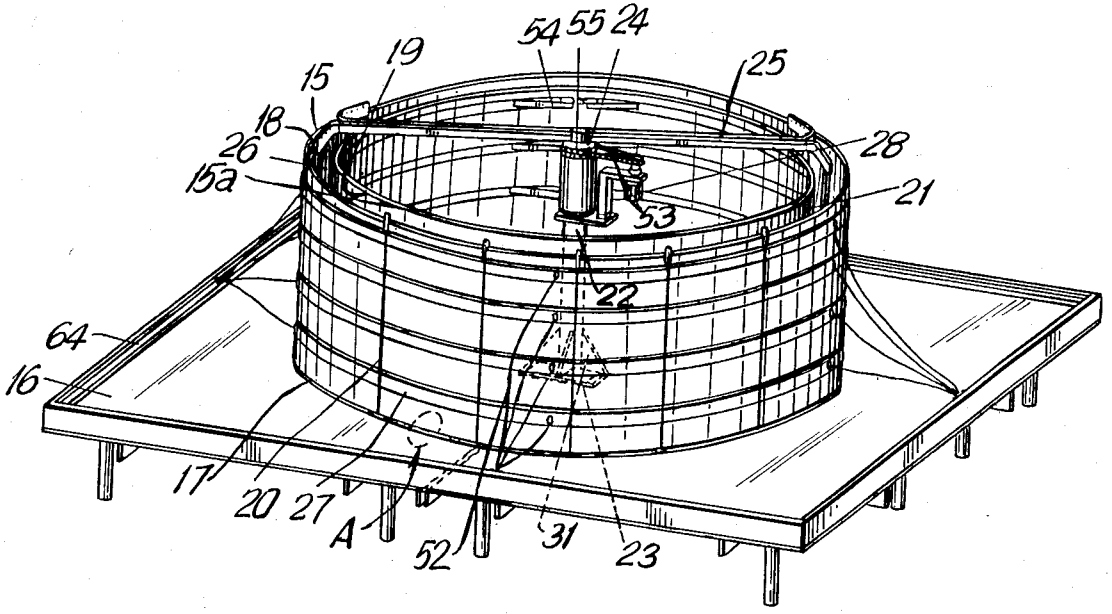
FIG. 2 is a perspective view of an apparatus for applying a metallic coating on a press belt.

In accordance with the present invention, FIG. 2 displays an apparatus for the electrodeposition of a hard chrome layer or coating on the inner surface of the radially outer endless press belt 15. The apparatus includes a rectangularly shaped horizontal base plate 16 formed of steel and dimensioned so that it can support the largest diameter endless press belt which must be chrome plated. In accordance with the present invention, the press belt 15 is placed on edge so that its width dimension extends upwardly from the base plate in the untensioned condition with the lower edge of the belt positioned in an annular seal 17 formed in the surface of the base plate so that the belt assumes the shape of a circular ring. Spaced radially within press belt 15 is another press belt similarly fitted into an annular seal 17 in the base plate and the belt is arranged to be covered. The radially inner press belt **15*a* has a smaller diameter than the radially outer press belt 15 and it is concentric relative to the press belt 15 about a common centerpoint on the base plate 16. The two press belts 15, 15*a* have the same width, that is, the height in the vertically arranged positions as shown in FIG. 2 whereby the two belts define the radial inner and outer boundaries of an annular open space 21 between the inner surface 18 of the outer belt 15 and the outer surface 19 of the inner belt 15*a***. An electrolytic solution, usually chromic acid, is filled into the annular space.

The two belts 15, **15*a* are firmly secured on the base plate 16 by clamping elements 20 on the outer belt and counter-clamping elements 54 on the inner belt so that the annular arrangement and relationship between the two are maintained in a fixed manner during the electrodeposition process. The clamping elements 20 are secured so that they hold the press belt 15 at locations outside the annular space 21. The radially inner belt 15*a* is clamped from the inside by the counterclamping elements 54 so that it assumes a circular shape. A mast 22 is located at the common centerpoint of the two concentric circles formed by the belts 15, 15*a* with the mast supported on and extending upwardly from the base plate and being secured to the base plate. There is no electrically conductive connection between the mast 22 and the base plate 16 because an insulation plate 23** formed of a plastics material is located between the mast and the base plate.

At the upper end of the mast 22, an outer sleeve 24 is rotatably supported. Sleeve 24 extends in the axial direction of the mast 22. Outer sleeve 24 supports at its upper end a pair of arms 25 extending in opposite directions. The arms 25 are formed of copper and define an angle of 180°. The length of each arm is greater than the radius of the inner belt **15*a* and smaller than the radius of the outer belt 15. The arms are located at a vertical height above the base plate 16 so that they are positioned upwardly from the upper edges of the press belts 15, 15*a*. Lead rods or bars 26 are fastened to the radially outer ends of the arms 25 and extend downwardly within the annular bath or space 21 to closely above the base plate 16. Due to the selected lengths of the arms 25, the lead rods 26 are spaced from the inner surface 18 of the belt 15 as well as from the outer surface 19 of the belt 15*a* and, therefore, do not contact these surfaces while the sleeve 24 rotates and carries with it the arms 25**.

A number of annular collars 27 are secured around the outer surface of the press belt 15 so that a collar 27 is located at the bottom and top edges of the press belt with other collars being spaced in the vertical direction for the height of the belt 15. The collars 27 are fixed in position by the clamping elements 20. The clamping elements 20 are insulated electrically relative to the base plate 16. Since the belt 15 rests on an annular seal 17 of rubber or plastics material, there is no electrical contact between the belt 15 and the base plate 16.

Figure 3:
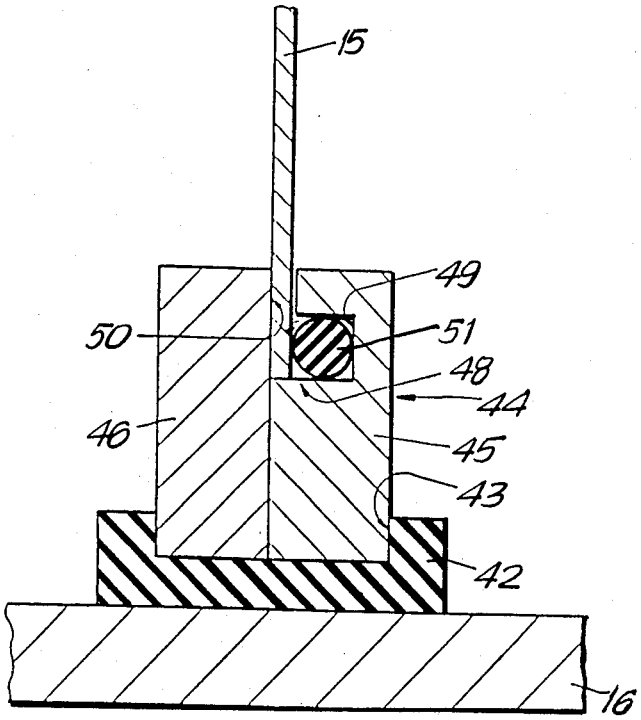
FIG. 3 is an enlarged sectional view illustrating the placement of the press belt on a base plate.

FIG. 3 shows the arrangement of an annular seal 17 for the portion of the belt 15 located in the region A in FIG. 2. The seal is formed of an annular body 42 bearing on the upper surface of the base plate 16. The body 42 is formed of an electrically non-conductive material such as rubber or plastics. The upper surface of the body 42 forms an annular groove 43 in which a holder 44 is securely fitted. Holder 44 is made up of two parts, that is, two annular iron rails 45, 46. One of the iron rails 45 forms a step 48 in its upper region and it has a groove 49 adjoining the step 48. Press belt 15 is placed in the holder 44 so that it stands upright on the step 48 of the iron rail 45 and adjoins the wall surface 50 of the other iron rail 46 for a lower portion of the surface facing the wall surface. An O-ring 51 is located in the groove 49 and presses the lower end of the press belt 15 against the wall surface 50. The contact pressure can be increased by allowing a fluid under pressure, for example, water or the electrolytic solution itself, to act on the O-ring 51 within the groove 49. With this arrangement the press belt 15 is supported securely on the base plate 16 and provides a seal for the electrolytic solution located in the annular space 21. Further, the press belt 15 is electrically insulated from the base plate 16.

The seal arrangement illustrated in FIG. 3 has the advantage that a secure annular upright position of the press belt 15 on the base plate 16 is assured by the rigid gripping of the press belt 15 in its lower region. The clamping elements 20 or the counter-clamping elements 54 may be dispensed with under certain circumstances with the press belt 15 freely supported on the base plate 16. When the clamping elements 20 or 54 are used, a simpler seal arrangement can be effected, since the seal does not have to exert any tensioning force. Sealing the joint between the press belt 15 and the base plate 16 by a silicon ring is sufficient.

For the electrodeposition of a hard chrome coating on the inner surface 18 of the radially outer belt 15, the collars 27 are connected by flexible lines 52 to an annular line 64 formed of copper rods with a sufficiently large metallic crosssection connected to the negative pole of a constant voltage source. The lead rods 26 forming the anode are connected with the positive pole of the constant voltage source via the arms 24 and the mast 22 supported by the base plate. Accordingly, the outer belt 15 is connected as the cathode and the lead rods 26 are connected as the anode. A motor 28 and a chain 53 effect the transmission of force to a toothed gear wheel 55 secured on the outer sleeve 24 of the mast 22, and the mast is driven so that the lead rods forming the anode rotate at a uniform speed through the annular bath. According to the known electrolytic principle, chrome atoms separate out of the electrolytic solution in the annular bath 21 onto the inner surface 18 of the press belt 15 which acts as a cathode, that is, on the part of the inner surface located opposite the anode 26. Since the anode 26 rotates, a chrome layer or coating of a determined thickness is deposited during each revolution on the entire inner surface 18 of the belt 15. The desired overall layer thickness of the hard chrome coating is obtained by the selection of the number of revolutions of the anode 26.

It is possible to increase the thickness of the coating deposited per revolution, by increasing the number of lead rods 26 forming the anode. With a great many adjacent lead rods, care must be taken that such rods are arranged in the form of a sector of a circle as seen in cross-section to assure that they do not contact either of the surfaces 18, 19 of the belts during the rotation of the outer sleeve 24.

Another way of enlarging the deposited coating thickness involve attaching more than two arms 25 extending outwardly from the outer sleeve 24 with anodes being attached to each arm. It must be noted in this operation that the current intensity increases correspondingly and the output of a constant voltage source must be afforded. It would also be possible to use a single arm 25 supporting the anode to be attached to the outer sleeve 24 when there is a low output of the current voltage source with the number of revolutions increasing for a predetermined overal coating thickness.

The sizing of the constant voltage source, normally a power transformer with adjoining rectifier, is effected according to the known laws of electrolysis. The characteristics of the deposited coating or layer depend in a sensitive manner on the temperature of the electrolyte and the current density, as is generally known in electroplating. The temperature of the electrolyte in the annular space 21 is constantly controlled by temperature sensors arranged in the annular space 21 and is maintained constant by supplying heated electrolyte. The supply of fresh electrolyte is effected from below through the base plate 16 into the hollow space. At the same time, the used electrolyte is replaced, since the deposition of the chrome on the belt surface correspondingly decreases its concentration. Accordingly, the temperature as well as the concentration of the electrolyte is constant throughout the entire electrodeposition period.

Due to the annular arrangement of the cathode and anode, the current density is automatically held constant at all locations, so that a very uniform coating thickness of the hard chrome is achieved on the entire belt surface. It is also found that hydrogen embrittlement rarely occurs whereby the danger that the surface layer will crack under tensile stress is limited. The bending fatigue strength of the belts, chrome-plated in accordance with the inventive method, is much higher than for belts chrome-plated in the conventional manner.

The current efficiency in depositing the hard chrome coating is approximately 20%, that is, approximately 80% of the required current is used for the electrolysis of water. Accordingly, gaseous hydrogen develops at the cathode and escapes from the annular space 21. The rising gas bubbles carry off a part of the electrolyte, so that the hydrogen gas is mixed with chromic acid vapor. Advantageously, a tent formed of a plastics foil or sheeting can be tensioned over the entire apparatus, as shown schematically in FIG. 5 by the reference numeral 30, with the vapors being captured and suctioned off in the tent.

Figure 4:
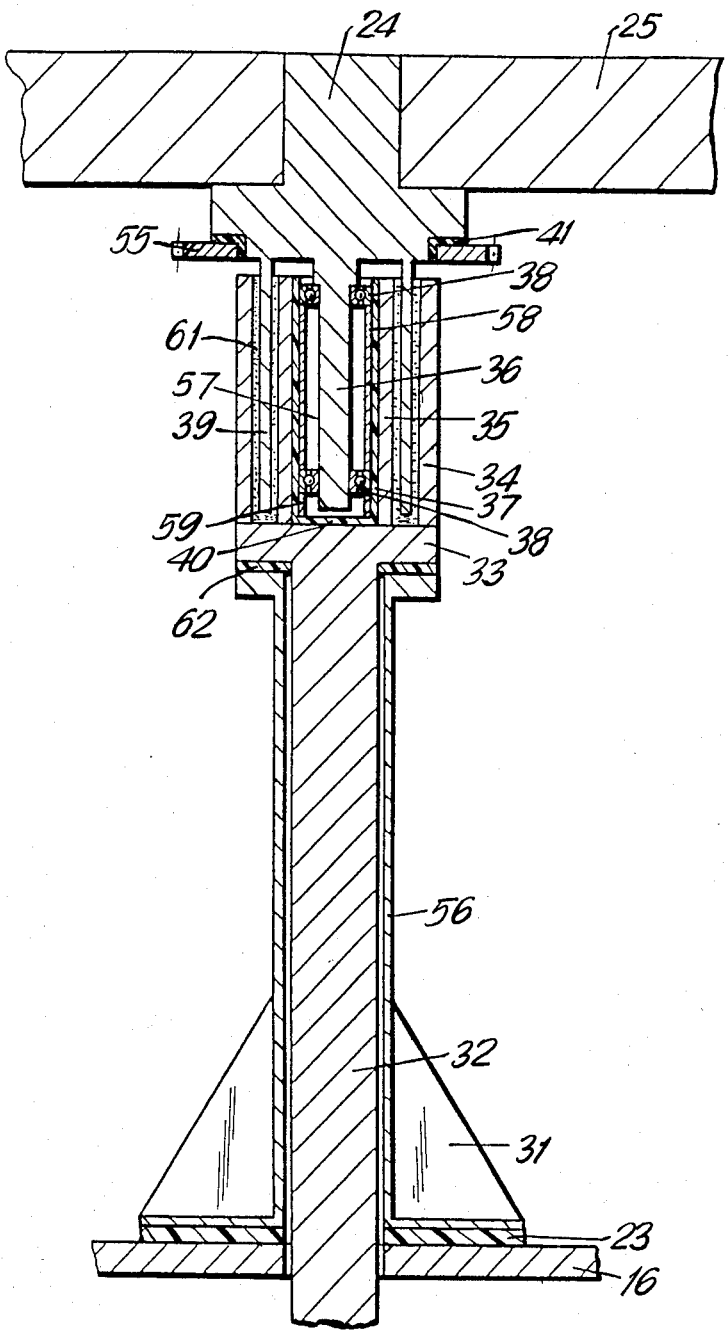
FIG. 4 is a cross-sectional view through a mast for supplying current.

To keep power losses as low as possible, the current supply lines to the anode and cathode must be formed with the least possible resistance. Accordingly, solid copper lines of large cross-secton are used, as is conventional in electroplating. Since the anode 26 moves during the electroplating operation, the current supply to the mast 22 has a particular arrangement as can be seen in cross-section in FIG. 4.

The mast 22 includes a hollow rectangular tube 56 which is secured to the base plate 16 by means of a laterally extending bottom flange 31 and the tube and its bottom flange are electrically insulated by a plastics material plate 23 from the base plate 16. A copper rod 32 extends downwardly through the rectangular tube 56 and passes through an opening in the base plate 16. The copper rod 32 receives the current supply from the constant voltage source through the opening in the base plate 16. The copper rod terminates at its upper end in a laterally outwardly extending flange 33 with an outer annular flange 34 and an inner annular flange 35 extending vertically upwardly from the flange 33 so that an annular space remains between the inner and outer annular flanges. There is no electrically conductive connection between the rectangular tube 56 and the flange 33, since they are separated by electrical insulation material 62. At its lower end the outer sleeve 24 has a downwardly projecting annular flange 39 and a centrally located downwardly extending shaft 36 positioned within the flange 39. Shaft 36 extends into the space formed within the inner annular flange 35 and it is secured so that it rotates on the inner annular flange by means of vertically spaced ball bearings 38. Accordingly, the shaft 36 and the entire outer sleeve in combination with it, can rotate around the stationary copper rod 32 located within the tube 56. The ball bearings 38 are insulated from the inner annular flange 35 by means of a plastics material insulation 37. The vertical spacing of the two ball bearings 38 is determined by an upper spacer sleeve 58 while the lower ball bearing is supported by a lower spacer sleeve 59 on an insulated plate 40 resting on the flange 33.

The annular flange 39 of the outer sleeve 24 extends down into the space between the inner annular flange 34 and the outer annular flange 34 so that a slight play of about 1/10 mm remains between the adjacent surfaces. The space provided due to the play, is filled with mercury 61. The mercury 61 has good electrical conductivity and ensures the transmission of current from the flange 33 through the stationary annular flanges 34, 35 to the rotatable flange 39 on the outer sleeve 24 and then to the anode 26 via the arms 25 located at the upper end of the sleeve 24.

A toothed gear wheel 55 driven by the motor 28 via the chain 53, effects the rotation of the outer sleeve 24 and is mounted on the outer sleeve just above the downwardly directed flange 39. Further, the motor is attached to the rectangular pipe 56. The gear wheel 55 is electrically insulated from the outer sleeve 24 by insulating foils 41 so that there is no flow of current from the outer sleeve 24 over the chain 53 to the motor 28 and the rectangular pipe 26. In addition, this arrangement assures that no flow of current passes to the shaft 36 from the inner annular flange 35 through the ball bearings 38, since the large current flow required for the electrodeposition of the chrome would cause dangerous overheating at the small cross-sections of the ball bearings. The shaft 36 is spaced from the insulating plate 40 and, accordingly, from the flange 33.

If the outer surface of a press belt is to be chrome-plated instead of the inner surface, then the belts are arranged in the apparatus so that the band with the smaller diameter is wired as the cathode. In FIG. 2 the inner belt is the press belt **15*a* with the surface 19 to be chrome-plated. The connection of the cathode with the negative pole of the voltage source is effected over supply lines located on the inside of the press belt 15*a*, corresponding to the above description, while the anode is connected, as above, to the lead rods 26. Otherwise, the overall arrangement remains the same. The chrome from the electrolyte located in the annular bath is deposited on the outer surface 19 of the press belt 15*a* and forms the desired chrome coating when the voltage source is switched on and the arms 26** rotate.

Figure 5:
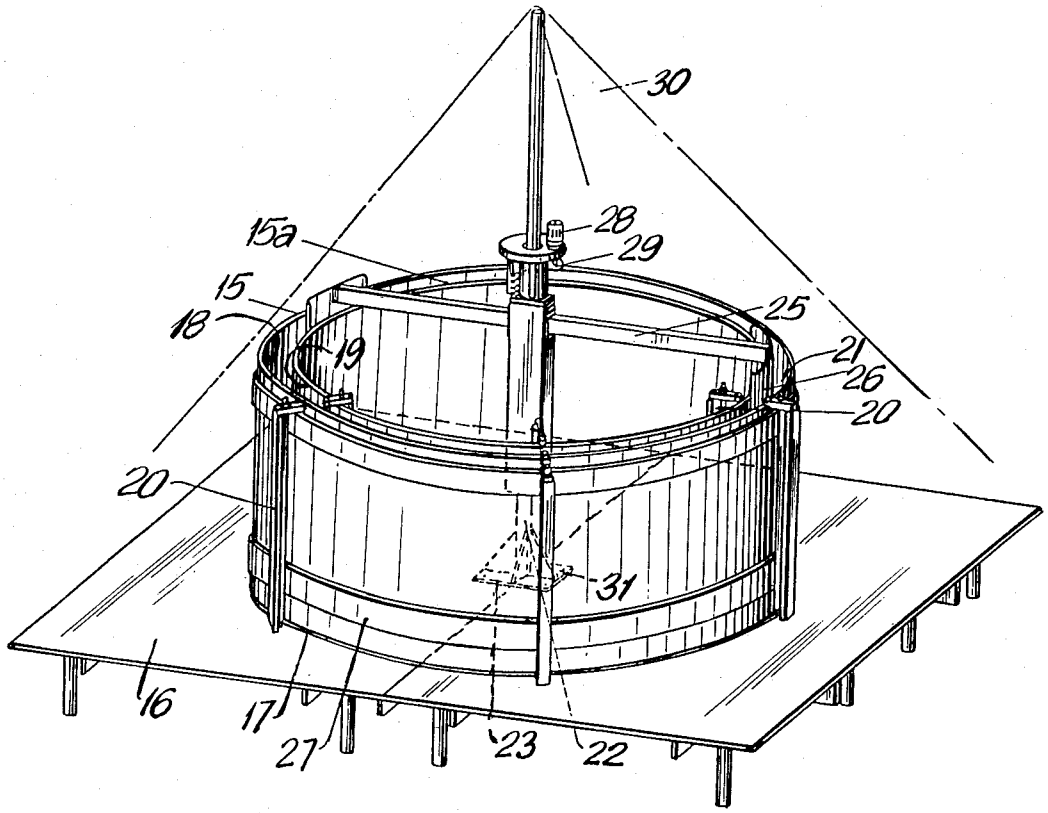
FIG. 5 is a perspective view of an apparatus for the simultaneous coating of a pair of press belts.

In a preferred manner, two press belts may be coated with chrome at the same time using the apparatus in accordance with the present invention, wherein the inside surface is chrome-plated on the radially outer belt and the outside surface is chrome-plated on the radial inner belt. Collars are attached on the inside of the inner belt **15*a* corresponding to the collars 27 on the outer belt 15. Collars 27 are secured on the outer belt 15, as well as on the inner belt 15*a*, by means of the clamping elements 20 which are formed of copper rods, as shown in FIG. 5 and in this embodiment also serve for the current supply. Otherwise, the apparatus shown in FIG. 5 is assembled in the same manner as that in FIG. 2 with the exception that the driving force from the motor 28 to the outer sleeve 24 is effected over a gear unit 29 with suitably selected gear reduction. Similar parts in FIG. 2 and FIG. 5** have the same reference numerals.

The collars 27 on the outer belt 15 and on the inner belt **15*a* are connected with the negative pole of the voltage source so that both belts simultaneously form the cathode. As the arms 25 rotate with the lead rods 26 acting as the anode, chrome is deposited on the inner surface 18 of the outer belt 15 and on the outer surface 19 of the inner belt 15*a***. Accordingly, a surface of each of the belts is covered with a chrome coating. When sizing the voltage source, a higher current requirement must be observed.

Figure 6:
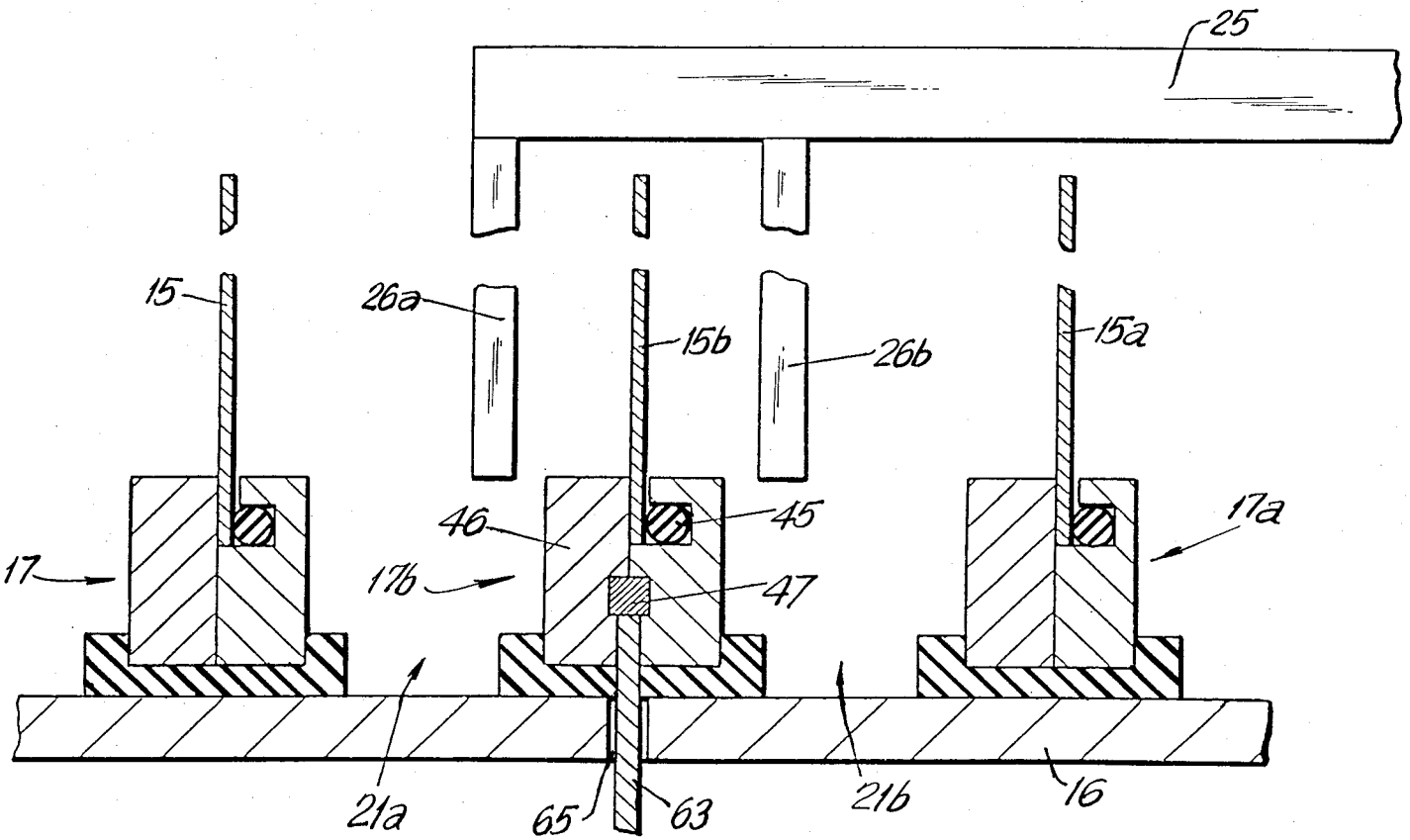
FIG. 6 is a partial cross-sectional view through an apparatus for effecting the simultaneous coating of two opposite surfaces of a press belt.

In another arrangement, in accordance with the present invention, it is possible to deposit a coating of chrome on both the inner and outer surfaces of a single press belt **15*b*. In this arrangement, three press belts 15, 15*b* and 15*a* are supported extending upwardly from the base plate 16 so as to be concentrically arranged relative to one another with the belts having different diameters. In FIG. 6 a sectional view is taken along the diameter of the annular bath inwardly toward the common center point. Each press belt rests on a corresponding seal 17, 17*b*, 17*a* where the inner and outer seals 17 and 17*a* are formed corresponding to the seal shown in FIG. 3 whereby additional clamping members for the press belts are not required. If it is considered advisable, the inner belt 15*a* and the outer belt 15 can also be clamped with the clamping elements 20, 54 whereby the use of the seal for the two press belts 15, 15*a*** would be unnecessary.

The middle press belt **15*b*, however, is gripped in such a seal so that its inner and outer surfaces are not covered and can be simultaneously coated with chrome. Further, the middle press band 15*b* is secured on the base plate in a fixed manner. The seal 17*b* includes a journal ring 47 which extends in the two iron rails 45, 46 and is formed of a material with good electrical conducting characteristics, such as copper. The journal ring 47 is connected at a plurality of locations with the negative pole of the voltage source through the openings 65 in the base plate 16 by means of the contact plug 63**, whereby the band is connected as a cathode.

In the arrangement in FIG. 6, the annular space between the inner and outer press belts is divided into an outer annular space between the outer belt 15 and the middle belt **15*b* and an inner annular space 21*b* between the middle belt 15*b* and the inner belt 15*a*. An anode 26*a* extends downwardly into the bath Iocated in the space 21*a* and another anode 26*b* extends downwardly into the inner space 21*b*. Both of the anodes 21*a*, 21*b* are formed of lead rods extending downwardly from an arm 25. The construction of the anodes and their connection over the arms 25 and the mast 22 is effected in the same way as described above. The two annular spaces 21*a*, 21*b* are filled with the electrolyte. Since the outer press belt 15 and the inner press belt 15*a* are not connected with the voltage source, an electric field is established between the middle press belt 15*b*, acting as the cathode, and the outer and inner parts 26*a*, 26*b* of the anode, so that when the anode rotates, and the voltage source is switched on, a chrome coating is simultaneously deposited on the inner and the outer surfaces of the press belt 15*b*. The method of and the apparatus for effecting the electrodeposition of a metal layer has been described by the example for depositing the hard chrome coating on a press belt surface. It will be appreciated, however, that the method and the apparatus can be used for the electrodeposition of a different metal coating on the press belt, such as for depositing a copper layer or a nickel layer. Depending on the metal to be deposited, the conditions to be maintained during the electrodeposition are observed. The anode 26 must be formed of a particular material under the given circumstances, for instance, in the case of a copper coating on the press belt the anode is formed of copper rods. If it should seem advisable, a single continuous surface can be utilized for the anode in place of the anode 26** formed of individual rods. Similarly, the electrolyte to be to be selected is a type familiar to persons skilled in the art.

While specific embodiments of the invention have been shown and described in detail to illustrate the application of the inventive principles, it will be understood that the invention may be embodied otherwise without departing from such principles.

I claim:

1. Apparatus for the electrodeposition of a metal coating comprising an electrolytic bath including a generally horizontally arranged base plate, wall means secured to and extending upwardly from said base plate forming an annular bath having a generally circularly extending radially inner surface and a generally circularly extending radially outer surface spaced outwardly from the inner surface and said inner and outer surfaces being concentric about a common centerpoint located on said base plate, said annular bath arranged to contain an aqueous electrolytic solution extending between and contacting said inner and outer surfaces, said wall means comprising at least a first endless press belt for use in a double band press having a first face surface directed toward the common centerpoint and a second face surface forming said inner surface of said annular bath and a second endless press belt having a first face surface directed toward the common centerpoint and forming the outer surface of said annular bath and an oppositely directed second surface, a vertically extending mast extending vertically upwardly from the common centerpoint and being electrically insulated from said base plate, a pair of generally horizontally extending arms each having a first end and a second end with the first ends thereof secured to the top of said mast and said arms extending radially outwardly therefrom with the second ends located spaced radially outwardly from the inner surface, means for forming an anode located within said annular bath, a constant voltage source, means connecting said constant voltage source to said anode forming means and to a selected part of said wall means for forming a cathode so that an electrodeposition of a metal coating takes place from the electrolytic solution onto the selected part of said wall means.

2. Apparatus, as set forth in claim 1, wherein said arms on said mast are positioned above the upper ends of said first and second endless press belts and said anode forming means extend downwardly from the second ends of said arms into said belt with the anode forming means located closely above said base plate.

3. Apparatus, as set forth in claim 1, wherein said first press belt forms the selected part of said wall means.

4. Apparatus, as set forth in claim 1, wherein said second press belt forms the selected part of said wall means.

5. Apparatus, as set forth in claim 3, wherein collars extend around the inner surface of said first press belt and said collars are connected to said constant pressure source for affording the cathode connection to said first endless press belt.

6. Apparatus, as set forth in claim 4, wherein collars extend around the inner surface of said second press belt and said collars are connected to said constant pressure source for affording the cathode connection to said first endless press belt.

7. Apparatus, as set forth in claim 1, wherein said wall means includes a third endless press belt having a greater diameter than said first endless press belt and a smaller diameter than said second endless press belt and supported on and extending upwardly from said base plate and spaced radially outwardly from said first press belt and radially inwardly from said second press belt, said annular bath being divided by said third press belt into a first radially inner annular bath section and a second radially outer annular bath section, and said third endless belt forming the selected part of said wall means and being connected to said constant voltage source for forming said cathode.

8. Apparatus, as set forth in claim 1, wherein an annular seal is supported on said base plate for each of said first and second endless belts.

9. Apparatus, as set forth in claim 8, wherein said annular seal comprises an annular member formed of an elastomeric material and having an annular groove formed in its upwardly directed surface, said annular member being supported on said base plate, a holder comprising a pair of annular metal rails positioned in the groove in said annular member and extending upwardly therefrom, one of said metal rails having a step formed therein located below the upper surface thereof and said step providing a support surface for said endless belt inserted between said metal rails, and a groove formed in said metal rail forming said step with said groove facing the other said metal rail.

10. Apparatus, as set forth in claim 9, wherein an O-ring is located in said groove in said metal rail forming said step and said O-ring presses said press belt supported on said step against the adjacent surface of the other said metal rail.

11. Apparatus, as set forth in claim 9, wherein said metal rails are formed of iron.

12. Apparatus, as set forth in claim 11, wherein said annular member is formed of rubber.

13. Apparatus, as set forth in claim 12, wherein a third endless press belt is located between said first and second endless press belts within said bath and is supported by one of said annular members, said annular member supporting said third press belt includes a trunnion journal extending through said press plate upwardly into said annular member whereby said trunnion ring is secured to said constant voltage source for forming said third press ring as the cathode.

14. Apparatus, as set forth in claim 1, including a tent-like cover extending over said annular bath formed between said first and second endless belts and arranged for affording a suction action.

15. Apparatus, as set forth in claim 1, wherein clamping members secure said second endless press belt to said base plate.

16. Apparatus, as set forth in claim 1, wherein clamping members secure said first endless press belt to said base plate.

17. Apparatus, as set forth in claim 1, wherein counterclamping members are secured to the inner surface of said first press belt for maintaining said first press belt in a circular shape.

18. Apparatus, as set forth in claim 5, wherein said collars are secured to the outer surface of said second press belt by clamping members.

19. Apparatus, as set forth in claim 18, wherein said collars are formed of copper.

20. Apparatus, as set forth in claim 5, wherein said constant voltage source has a negative pole and a positive pole, said collars are connected to said negative pole through said base plate by clamping elements formed of copper.

21. Apparatus, as set forth in claim 1, wherein said constant voltage source comprises a positive pole and a negative pole, a ring circuit located on said base plate and connected to said negative pole, and flexible lines extending from said ring circuit to said collar.

22. Apparatus, as set forth in claim 1, wherein said anode comprises a plurality of individual rods disposed closely adjacent to one another and fastened to the second ends of said arms of said mast.

23. Apparatus, as set forth in claim 1, wherein said mast comprises a hollow rectangular pipe having a lower end located closely above said base plate and an upper end spaced upwardly from said lower end, an outer sleeve located above said rectangular pipe, means for rotatably supporting said outer sleeve on said rectangular pipe, a vertically extending copper rod located within said rectangular pipe, said voltage source comprising a positive pole and a negative pole and said copper rod extending through said base plate and being connected to said positive pole.

24. Apparatus, as set forth in claim 23, wherein said outer sleeve having a toothed gear wheel mounted thereon, a motor, a chain extending between said motor and said toothed gear wheel for rotating said outer sleeve.

25. Apparatus, as set forth in claim 23, wherein a gear unit is disposed in meshed engagement with said outer sleeve and a motor connected to said gear unit for rotating said outer sleeve.

26. Apparatus, as set forth in claim 23, wherein said means for rotatably supporting said outer sleeve includes a metallic fluid for effecting the transfer of current from said voltage source to said outer sleeve.

27. Apparatus, as set forth in claim 26, wherein said metallic fluid is mercury.

* * * * *